US008519355B2

(12) United States Patent
Buhler et al.

(10) Patent No.: US 8,519,355 B2
(45) Date of Patent: Aug. 27, 2013

(54) CHARGED PARTICLE SOURCE

(71) Applicant: Carl Zeiss Microscopy GmbH, Oberkochen (DE)

(72) Inventors: Wolfram Buhler, Hermaringen (DE); Matthias Langer, Heubach (DE); Xiong Liu, Stuttgart (DE)

(73) Assignee: Carl Zeiss Microscopy GmbH, Oberkochen (DE)

( * ) Notice: Subject to any disclaimer, the term of this patent is extended or adjusted under 35 U.S.C. 154(b) by 0 days.

(21) Appl. No.: 13/646,037

(22) Filed: Oct. 5, 2012

(65) Prior Publication Data

US 2013/0087716 A1 Apr. 11, 2013

Related U.S. Application Data

(60) Provisional application No. 61/544,418, filed on Oct. 7, 2011.

(51) Int. Cl.

| | |
|---|---|
| ***H01J 49/10*** | (2006.01) |
| ***H01J 27/26*** | (2006.01) |
| ***H01J 27/24*** | (2006.01) |
| ***H01J 3/14*** | (2006.01) |

(52) U.S. Cl.

USPC ..... 250/423 F; 250/423 R; 250/396 R; 250/396 ML; 250/423 P; 315/111.81; 315/111.01; 438/961

(58) Field of Classification Search

USPC ..... 250/423 F, 423 R, 396 R, 396 ML, 250/423 P; 315/111.81, 111.01; 438/961

See application file for complete search history.

(56) References Cited

U.S. PATENT DOCUMENTS

| | | | | |
|---|---|---|---|---|
| 5,054,046 | A * | 10/1991 | Shoulders | 378/119 |
| 7,709,807 | B2 | 5/2010 | McClelland et al. | |
| 2007/0158580 | A1 | 7/2007 | Ward et al. | |
| 2008/0296483 | A1 | 12/2008 | McClelland et al. | |
| 2009/0152462 | A1 * | 6/2009 | Ishitani et al. | 250/307 |
| 2010/0108902 | A1 | 5/2010 | Frosien et al. | |
| 2011/0210264 | A1 | 9/2011 | McClelland et al. | |
| 2013/0087704 | A1 * | 4/2013 | Ishitani et al. | 250/307 |

FOREIGN PATENT DOCUMENTS

WO WO 2010/132265 A2 11/2010

OTHER PUBLICATIONS

NIST, "Magneto-optical trap-based ion source (MOTIS)," Univ. of York, Feb. 2008, 2 pp.

H. J. Metcalf et al., "Laser cooling and trapping of atoms," J. Opt. Soc. Am. B, vol. 20, No. 5, May 2003, pp. 887-908.

(Continued)

*Primary Examiner* — Nikita Wells

(74) *Attorney, Agent, or Firm* — Muirhead and Saturnelli, LLC

(57) ABSTRACT

A charged particle source comprises at least one gas inlet configured to supply gas particles, at least one tip having a tip apex being biased to provide an electrical field for generating charged particles, and at least one ionization area to which gas particles are supplied. The gas particles are ionized in the ionization area due to the electrical field. Additionally, the charged particle source comprises at least one first electrode configured to accelerate charged particles and at least one light emitting device providing a light beam. The light beam is focused to a focus point in the ionization area, specifically, to a focus volume such that the ionization area is at least partly positioned in the focus volume. The ionization area is arranged between the tip apex and the first electrode. The distance between the ionization area and the tip apex may be from 0.1 nm to 1 nm.

20 Claims, 10 Drawing Sheets

(56) References Cited

OTHER PUBLICATIONS

J. G. C. Tempelaars, "Trapping Metastable Neon Atoms (diss.)," Eindhoven 2001, 124 pp.
Erik Gustafsson, "Design study of a Magneto-Optical Trap for laser cooling of Rubidium atoms," Master's Thesis, Lund, Jun. 2004, 44 pp.
William D. Phillips, "Laser Cooling and Trapping of Neutral Atoms," Reviews of Modern Physics, vol. 70, No. 3, Jul. 1998, 721-741.
P. L. Chapovsky, "Compact Magneto-Optical Trap for Rubidium Atoms," Journal of Experimental and Theoretical Physics, vol. 100, No. 5 (2005), pp. 911-919.
Hanspeter Helm, "Dissipative Processes in Light-Atom Interaction," Lecture Notes, Chapter 4: Magneto-Optic Trap, University of Freiburg, lecture held in 2010, published Apr. 17, 2011, pp. 27-32 (with machine translation of parts not in English).
"Laser Cooling and Trapping," Advanced Optics Laboratory, available from http://www.web.pdx.edu/~larosaa/Applied_Optics_464-564/Projects_Presented/Projects-2006/Laser%20Cooling/LaserCooling3.doc.pdf, Mar. 2006, 16 pp.
Tao Li, "Manipulation of Cold Atoms Using an Optical One-Way Barrier," Dissertation, Univ. of Oregon, Sep. 2008, 135 pp.
Vadim Sidorkin et al.,"Sub-10 nm nanolithography with a scanning helium beam," J. Vac. Sci. Technol. B 27 (4), Jul./Aug. 2009, pp. L18-L20.
Colin A. Sanford et al., "Beam induced deposition of platinum using a helium ion microscope," J. Vac. Sci. Technol. B 27(6), Nov./Dec. 2009, 8 pp.
T. Hänsch et al. "Cooling of Gases by Laser Radiation," Optics Commun , vol. 13, No. 1, Jan. 1975, pp. 68-69.
W. Neuhauser et al. "Optical-Sideband Cooling of Visible Atom Cloud Confined in Parabolic Well," Phys. Rev. Lett., vol. 41, No. 4, Jul. 24, 1978, pp. 233-236.

* cited by examiner

CHARGED PARTICLE SOURCE

RELATED APPLICATIONS

This application claims priority to U.S. Provisional App. No. 61/544,418, filed Oct. 7, 2011, which is incorporated herein by reference.

TECHNICAL FIELD

This application relates to a device for producing charged particles, and in particular, to producing charged particle beams in a charged particle beam device.

BACKGROUND OF THE INVENTION

A charged particle beam, such as an ion beam, is used to analyse and/or to process an object (sample) in a particle beam device. Such a particle beam device may comprise a charged particle source (for example, a gas field ion source) for generating ions that are used to analyse and/or to process an object.

A first charged particle source known from the prior art comprises a gas source and a gas field ion source. The gas source is able to supply one or more gases to the gas field ion source. At least one of the gases supplied by the gas source may be a noble gas (helium (He), neon (Ne), argon (Ar), krypton (Kr) and xenon (Xe)). The gas source may also supply atoms of lithium (Li), sodium (Na), potassium (K), oxygen (O), rubidium (Rb), cesium (Cs), francium (Fr), magnesium (Mg), calcium (Ca) or strontium (Sr). The gas field ion source comprises a tip with a tip apex, a first electrode in the form of an extractor electrode and a second electrode in the form of a suppressor electrode.

The tip (which may be electrically conductive) may be formed of various materials. For example, the tip may be formed of a metal. The metal may be tungsten (W), tantalum (Ta), iridium (Ir) or platinum (Pt). In other embodiments, the tip may be formed of an alloy. During use, the tip is biased positively with respect to the extractor electrode. The extractor electrode is negatively or positively biased with respect to an external ground. Moreover, the suppressor electrode is biased positively or negatively with respect to the tip. Due to the shape of the tip, an electric field is strong in the vicinity of the tip apex. The suppressor electrode assists in controlling the overall electric field between the tip and the extractor electrode. Neutral gas particles supplied by the gas source are ionized due to the electrical field and become positively charged ions in the vicinity of the tip. The positively charged ions are repelled by the positively charged tip and attracted to the extractor electrode.

A second charged particle source known from the prior art uses a trap for collecting neutral gas particles in a specific area. One embodiment of the second charged particle source comprises a single focused laser beam of a first laser to cool or trap neutral gas particles in a specific area. An alternative embodiment of the second charged particle source comprises a magneto-optical trap. A magneto-optical trap comprises an enclosure such as a vacuum chamber, a component for providing a magnetic field and a collection of first lasers. The wavelength of the laser beams of the first lasers is tuned close to, but just above, the resonance of the neutral gas particles provided by a gas source, or alternatively the laser energy is tuned just below the resonance absorption energy, thereby creating a velocity-dependent force which slows down the neutral gas particles. The magnetic field contributes position dependence to this force, creating a trap center within the overlap of the laser beams of the first lasers. A second laser, which is different from the first lasers, is used to ionize trapped neutral gas particles, to thereby form ions. The wavelength of the beam of the second laser is selected such that the energy of a photon from the second laser is just enough to ionize the trapped neutral gas particles.

US 2010/0108902 A1, US 2007/0158580 A1, US 2008/0296483 A1, US 2011/0210264 and U.S. Pat. No. 7,709,807 B2 are prior art references, which are incorporated herein by reference.

Charged particles generated by a charged particle source form the particle beam of a particle beam device having such a charged particle source. The charged particle beam current depends on the number of generated charged particles. It is obvious that a high charged particle beam current is advantageous for obtaining good imaging or processing conditions. In particular, for specific material imaging, material analysis, beam induced deposition and/or beam induced implantation, it is advantageous to have a relatively high charged particle beam current. Moreover, a relatively high charged particle beam current supports a faster scanning of a particle beam over an object at a high signal-to-noise ratio. Accordingly, there is always a need to provide a charged particle source for generating a high number of charged particles to achieve a relatively high charged particle beam current.

SUMMARY OF THE INVENTION

According to the system described herein, a charged particle source comprises at least one gas inlet configured to supply gas particles and at least one tip having a tip apex being biased to provide an electrical field for generating charged particles. Moreover, the charged particle source according to the system described herein comprises at least one ionization area to which gas particles are supplied. The gas particles are ionized in the ionization area due to the electrical field. Additionally, the charged particle source according to the system described herein comprises at least one first electrode configured to accelerate charged particles and at least one light emitting device providing a light beam. The light beam is focused to a focus point in the ionization area. In other words, the light beam is focused to a focus volume in a manner that the ionization area is at least partly positioned in the focus volume. The ionization area is arranged between the tip apex and the first electrode. The distance between the ionization area and the tip apex may be from 0.1 nm to 1 nm.

The system described herein is based on the following considerations. The light beam of the light emitting device assists in providing a relatively high concentration of neutral gas particles provided by the gas source in the vicinity of the tip by trapping or cooling neutral gas particles in the ionization area due to an interaction of the neutral gas particles with the light beam. This leads to a relatively high ionization rate of neutral gas particles which are ionized to charged gas particles and, therefore, to a relatively high charged particle beam current.

The cooling or trapping of neutral gas particles with light from a light emitting device (for example, a laser) is based on the interaction of the light and the neutral gas particles (for example, atoms). The energy of the light changes the internal energy of the atoms. A momentum exchange between the light field and the atoms results in a force exerted on the atoms. This force is used to either cool the atoms (to slow down the atoms) or to trap the atoms.

In an embodiment of the system described herein, the light emitting device may be a laser. It may have a power of a few 100 mW and a wavelength in the area of 300 nm to 1100 nm.

The light emitting device may be chosen according to the gas particles. A frequency doubled Ti:sapphire laser may be used as a laser for He-gas particles. Additionally or alternatively, a DBR (Distributed Bragg Reflector) laser diode may be used for He-gas particles. Again, additionally or alternatively, a Nd:YAG laser (for Na-gas particles) or a $CO_2$ laser (for Cs-gas particles) may be used. However, the system described herein is not restricted to such a light emitting device. Any suitable light emitting device may be used.

In a further embodiment of the system described herein, the charged particle source additionally or alternatively comprises at least one reflecting element for reflecting the light beam in the direction of the focus point. The reflecting element may be a mirror element, for example. The position of the reflecting element with respect to the ionization area and the first electrode may be chosen. In one embodiment of the system described herein, seen from the ionization area in the direction of the first electrode, the charged particle source comprises the ionization area, the first electrode and the reflecting element. In other words, the aforementioned units are arranged in the following order: the ionization area-the first electrode-the reflecting element. In a further embodiment of the system described herein, seen from the ionization area in the direction of the first electrode, the charged particle source comprises the reflection element, the ionization area and the first electrode. In other words, the aforementioned units are arranged in the following order: the reflection element-the ionization area-the first electrode. In another embodiment of the system described herein, seen from the ionization area in the direction of the first electrode, the charged particle source comprises the ionization area, the reflection element and the first electrode. In other words, the aforementioned units are arranged in the following order: the ionization area-the reflection element-the first electrode. It is to be noted that the position of the reflection element with respect to the ionization area and the first electrode is not restricted to the above mentioned positions, but may be freely chosen.

In a further embodiment of the system described herein, the charged particle source additionally or alternatively comprises at least one optical fiber for guiding the light beam of the light emitting device in the direction of the focus point. This embodiment allows, for example, for the light emitting device being be arranged at a distance from the further units of the charged particle source, for example outside a vacuum chamber. The light beam of the light emitting device is transported to the focus point by the optical fiber. In a further embodiment of the system described herein, at least one lens element is additionally or alternatively provided for focusing the light beam to the focus point.

Additionally or alternatively, the charged particle source may comprise an optical axis along which charged particles are accelerated from the ionization area to the first electrode. Furthermore, the light beam and the optical axis are orientated towards each other such that they include an angle which is different from 0° and 180°. In other words, the light beam and the optical axis are not orientated parallel to each other. In order to increase the number of neutral gas particles in the ionization area, multiple light beams may be directed from opposite directions to the focus point. Thus, neutral gas particles from various directions may interact with a specific light beam of the multiple light beams, and are transported to the ionization area.

In a further embodiment, the charged particle source additionally or alternatively comprises an optical axis along which charged particles are accelerated from the ionization area to the first electrode. Furthermore, the light beam and the optical axis are orientated parallel to each other. In this embodiment of the system described herein, the light emitting device may be arranged behind the first electrode, seen from the ionization area in the direction of the first electrode, or before the ionization area, also seen from the ionization area in the direction of the first electrode.

Additionally or alternatively, the charged particle source may comprise at least one chamber. The chamber may be arranged around at least a part of the tip. In other words, the chamber may comprise at least a part of the tip. Furthermore, the chamber may comprise a cooling system. This embodiment of the system described herein allows for the temperature of the tip being kept at a temperature of a cooling medium which is comprised in the cooling system. Liquid nitrogen or liquid helium may be used as the cooling medium. Cooling the tip to a temperature of approximately equal to that of a cooling medium, serves to increase the concentration of the neutral gas particles in the ionization area. Therefore, a relatively high beam current may be achieved.

In a further embodiment of the system described herein, the chamber may comprise at least one wall having an inner side and an outer side. The inner side of the wall is directed to the tip and may comprise a first coating. The first coating may be gold-plated in order to reduce a radiation heat transfer between neighbouring surfaces. This embodiment allows for prevention of the ionization area being heated and, therefore, provides for a sufficient temperature to achieve a relatively high charged particle beam current. The outer side may comprise a second coating acting as a thermal insulator preventing heat transfer from the outside into the chamber.

In a further embodiment of the system described herein, the charged particle source additionally or alternatively may comprise at least one second electrode. The second electrode may be a suppressor electrode. Seen from the ionization area in direction of the first electrode, the charged particle source may comprise the second electrode, the ionization area and the first electrode. In other words, seen form the ionization area in direction of the first electrode, the aforementioned units are arranged in the following order: second electrode-ionization area-first electrode. In a further embodiment of the system described herein, additionally or alternatively, the first electrode may be an extractor electrode.

Moreover, the gas inlet may be connected to a gas supply unit comprising at least one of the following gases: helium, neon, argon, krypton and xenon. However, the system described herein is not restricted to these gases. In fact, any adequate gas may be used, in particular such gases as mentioned above.

In a further embodiment of the system described herein, the charged particle source additionally or alternatively comprises at least one magnetic device for providing a magnetic field, in particular an inhomogeneous magnetic field. In this embodiment, the light from the light emitting device may be used to cool the neutral gas particles. The magnetic field of the magnetic device is used to trap these neutral gas particles. Additionally or alternatively, this embodiment may also comprise several crossed light beams which are circularly polarized.

The system described herein also refers to a particle beam device comprising a charged particle source having one of the above mentioned features or a combination of at least two of the above mentioned features. Moreover, the particle beam device comprises an objective for focusing a particle beam on an object. The particle beam is a charged particle beam comprising charged particles generated by the charged particle source. The particle beam device may be a helium ion beam device for analyzing and/or processing an object.

BRIEF DESCRIPTION OF THE DRAWINGS

The system described herein will now be explained by reference to different embodiments shown in the figures. As will be realized, the system described herein admits other and different embodiments and its several details admit modifications in various respects, all without departing from the system described herein. Accordingly, the drawings and descriptions are to be regarded as illustrative and not restrictive. In the figures.

DETAILED DESCRIPTION OF VARIOUS EMBODIMENTS

Figure 1:
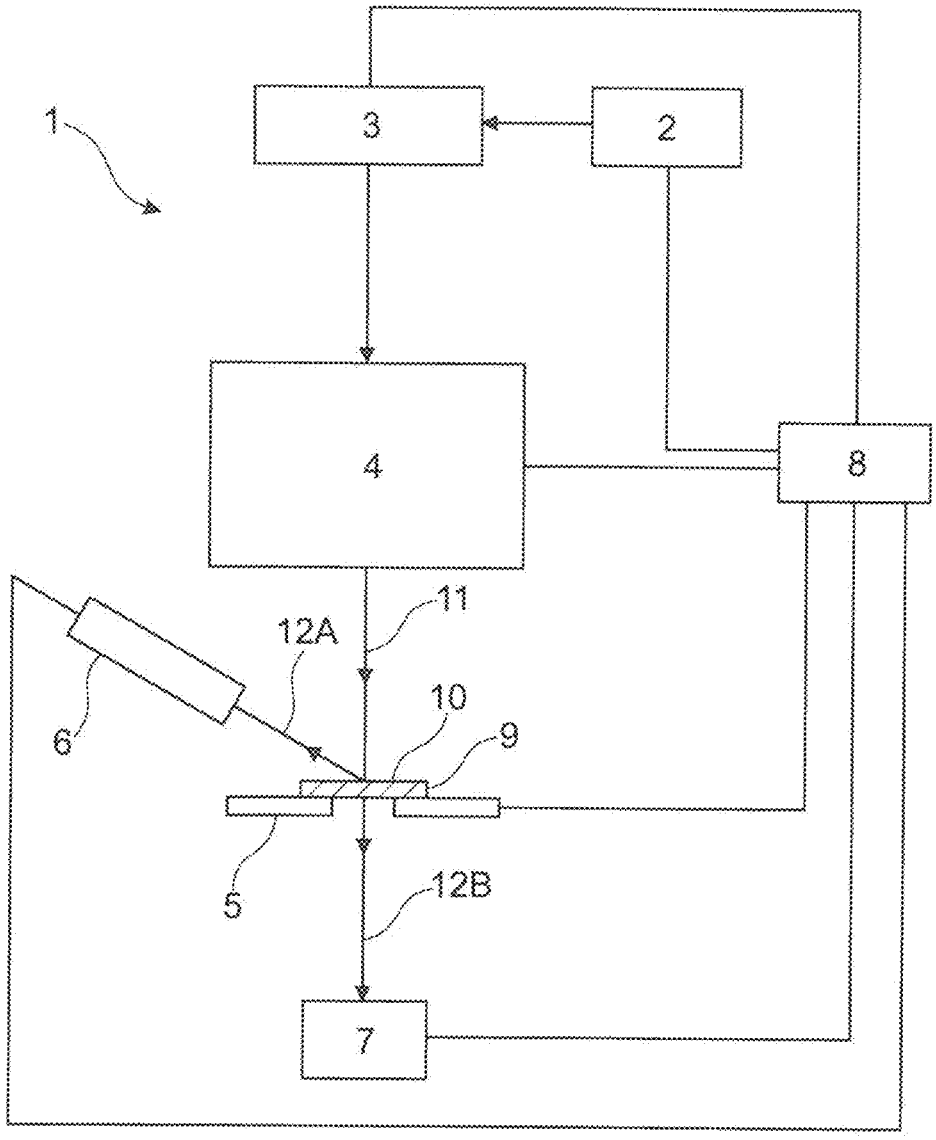
FIG. 1 shows a schematic diagram of a particle beam device.

FIG. 1 shows a schematic diagram of a particle beam device 1 that comprises a gas source 2, a charged particle source 3, ion optics 4, a sample stage 5, a first detector 6, a second detector 7 and a control system 8. The control system 8 is connected to various components of the particle beam device 1 via communication lines and controls the various components of the particle beam device 1.

A sample 9 is arranged on the sample stage 5. During use of the particle beam device 1, an ion beam 11 is generated by the charged particle source 3 and the ion optics 4, and is directed to a surface 10 of the sample 9. First particles 12A and second particles 12B resulting from the interaction of the ion beam 11 with the sample 9 are detected by the first detector 6 and the second detector 7. The first particles 12A may comprise ions of the ion beam 11 which are scattered at the sample 9, electrons which are emitted by the sample 9 (secondary electrons) or ions which are backscattered at the sample 9. The second particles 12B may comprise ions of the ion beam 11 which are scattered at the sample 9 or which are transmitted through the sample 9. It should be noted that the interaction of the ion beam 11 with the sample 9 may also result in generating interaction radiation, for example cathodo-luminescence light.

Figure 2:
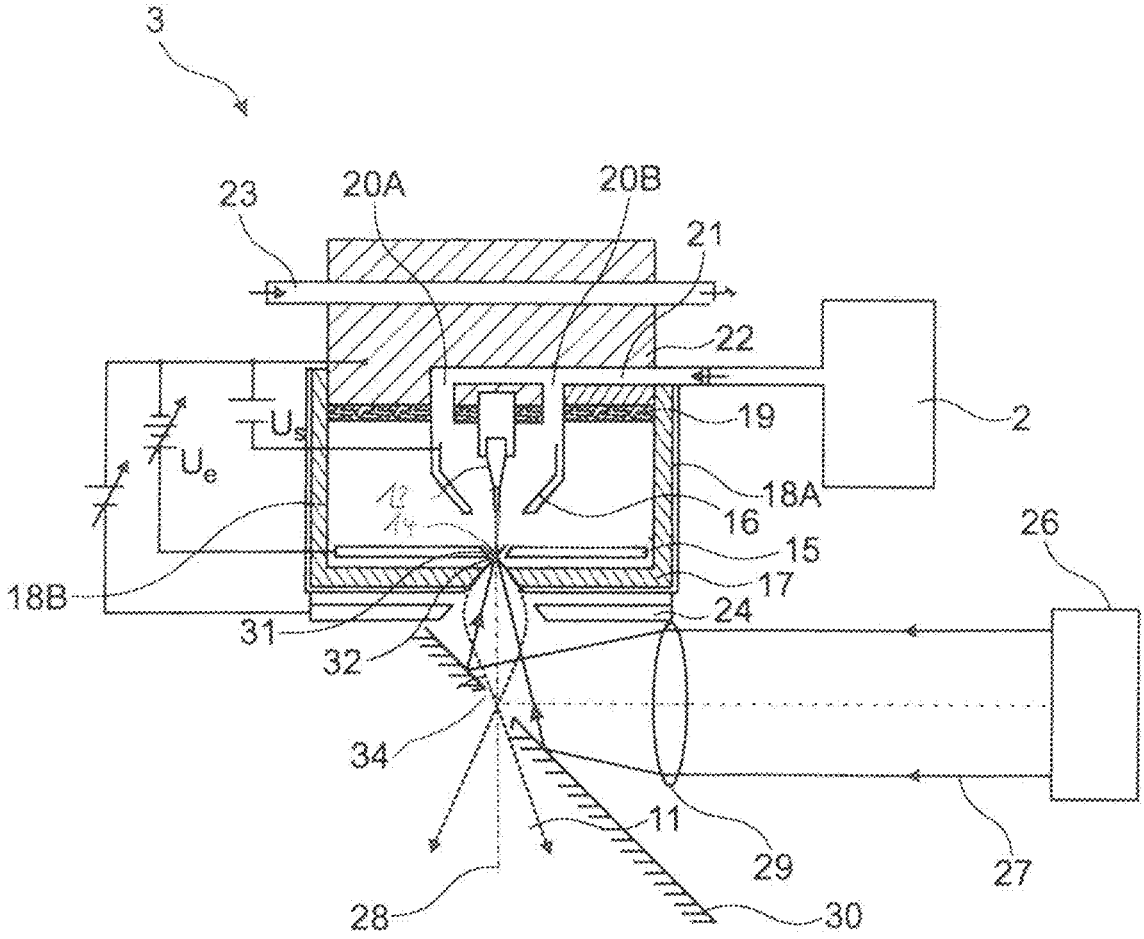
FIG. 2 shows a first embodiment of a charged particle source.

FIG. 2 shows an embodiment of the charged particle source 3. The charged particle source 3 is connected to the gas source 2. The gas source 2 can supply one or more gases to the charged particle source 3. The gas source 2 may be configured to supply gases at a variety of purities, flow rates, pressures and temperatures. In this embodiment, the gas source 2 is configured to supply helium, neon, argon, krypton and/or xenon. The charged particle source 3 is configured to receive those gases from the gas source 2 and to generate gas ions from those gases.

The charged particle source 3 comprises a tip 13 with a tip apex 14, a first electrode 15 in the form of an extractor electrode and a second electrode 16 in the form of a suppressor electrode. The tip 13 may be formed of various materials. In some embodiments, at least one of the following metals is used: tungsten, tantalum, iridium, rhenium, niobium, platinum and molybdenum. In other embodiments, the tip 13 can be formed of an alloy.

The tip 13 is biased positively (for example, approximately 1 kV-45 kV) with respect to the first electrode 15. The first electrode 15 is negatively or positively biased (for example from −20 kV to 45 kV) with respect to an external ground. The second electrode 16 is biased positively or negatively (for example from −5 kV to 5 kV) with respect to the tip 13. An electric field is provided at the tip apex 14 which points outward from the surface of the tip apex 14. Due to the shape of the tip 13, the electric field is strongest in the vicinity of the tip apex 14. The strength of the electric field of the tip 13 may be adjusted. This can be done for example by changing the voltage applied to the tip 13. The second electrode 16 assists in controlling the overall electric field between the tip 13 and the first electrode 15. The overall electric field between the tip 13 and the first electrode 15 can be adjusted to control the rate at which positively charged particles (ions) are generated at the tip apex 14. The charged particle source 3 also comprises an electrostatic lens 24 to form the ion beam 11 of the generated charged particles.

The charged particle source 3 also comprises a chamber 17. The tip 13 is arranged in the chamber 17, which has a first coating 18A on an outer side of a wall of the chamber 17. The first coating 18A may be a thermally insulating coating. Additionally, the chamber 17 comprises a second coating 18B on an inner side of the wall of the chamber 17. The inner side is directed to the tip 13. The second coating 18B may be a gold coating which prevents a heat transfer between the tip 13, the second electrode 16 and the wall of the chamber 17.

Furthermore, the chamber 17 comprises a thermal insulator 19. The thermal insulator 19 has a first opening 20A and a second opening 20B. A gas guiding system 21 of the gas source 2 is arranged at the first opening 20A and the second opening 20B. A cooling unit 22 is arranged next to the thermal insulator 19. The cooling unit 22 comprises a cooling tube 23 having an inlet and an outlet for transporting a cooling medium, for example liquid nitrogen or liquid helium. The cooling unit 22 facilitates cooling of the tip 13. In an alternative embodiment (not shown), the gas guiding system 21 may comprise more than two openings arranged at the thermal insulator 19. For example, the gas guiding system 21 may comprise an array of multiple openings which are circularly arranged around the tip 13.

The charged particle source 3 also comprises a light emitting device 26 in the form of a laser providing a light beam 27. Seen from the tip 13 in the direction of the first electrode 15, the units of the charged particle source 3 are arranged along the optical axis 28 in the following order: tip 13-first electrode 15-light emitting device 26. The light emitting device 26 may be a laser having a power of a few 100 mW and a wavelength in the range from 300 nm to 1100 nm. The specific wavelength of the light emitted by the light emitting device 26 depends on the kind of the gas atoms or gas molecules provided by the gas source 2 and the distances of their atomic or molecular energy levels. The wavelength of the emitted light should be adapted so that the quantum energy of the light photons is a little bit smaller than the resonance absorption energy of the gas atoms. It can be advantageous if the wavelength of the light emitting device 26 is tunable within a particular wavelength range so that the wavelength of the light can be tuned to fit to the desired absorption energy of the gas used.

However, the system described herein is not restricted to such a light emitting device 26 as described above. Any appropriate light emitting device 26 may be used.

The charged particle source 3 also comprises a lens 29 for focusing the light beam 27 to a focus point 31 in the vicinity of the tip apex 14. Before the light beam 27, after passing the lens 29, reaches the focus point 31, it is reflected or deflected by a reflecting element 30. It should be noted that the focus point 31 is not a point in the mathematical sense, but it is a small volume which has dimensions of several 100 nm (for example between 100 nm and 1000 nm) in each direction in space and, therefore, is much larger than the tip apex 14. As a result, the tip apex 14 as well as the ionisation area 32, which is formed, for example, at a distance of 0.1 nm to 1 nm in front if the tip apex 14 in the direction of the first electrode 15, are at least partly (or even completely) positioned within the focus point 31 or focus volume. The lens 29 is shown as a single lens but, in practice, it should be an objective lens or other focusing element which focuses the light beam 27 with a numerical aperture NA of larger than 0.6, and may even be larger than 0.8.

Neutral gas particles supplied by the gas source 2 are cooled or trapped by the light beam 27 of the light emitting device 26 at the focus point 31, more specifically in the ionization area 32 at least partly overlapping with the focus point 31. The neutral gas particles in the ionization area 32 are ionized due to the electrical field provided at the tip apex 14 and become positively charged ions in the vicinity of the tip 13. The positively charged ions are repelled by the positively charged tip 13 and attracted to the first electrode 15 to form the ion beam 11. The ion beam 11 is guided through an aperture 34 of the reflecting element 30.

As mentioned above, for laser cooling the gas atoms and/or the gas molecules, the quantum energy of the emitted light should be smaller than the gas atom's or gas molecule's resonance energy. The difference between the quantum energy of the emitted light and the resonance energy depends on the temperature of the gas and should be at least larger than the quantum energy corresponding to the Doppler shift frequency due to the thermal movement of the gas atoms or gas molecules with the average velocity corresponding to the thermal energy defined by the temperature of the gas. However, the difference between the quantum energy of the emitted light and the resonance energy should be smaller than ten times the quantum energy corresponding to the Doppler shift frequency due to the thermal movement of the gas atoms and/or gas molecules with the average velocity corresponding to the thermal energy defined by the temperature of the gas.

Figure 3A:
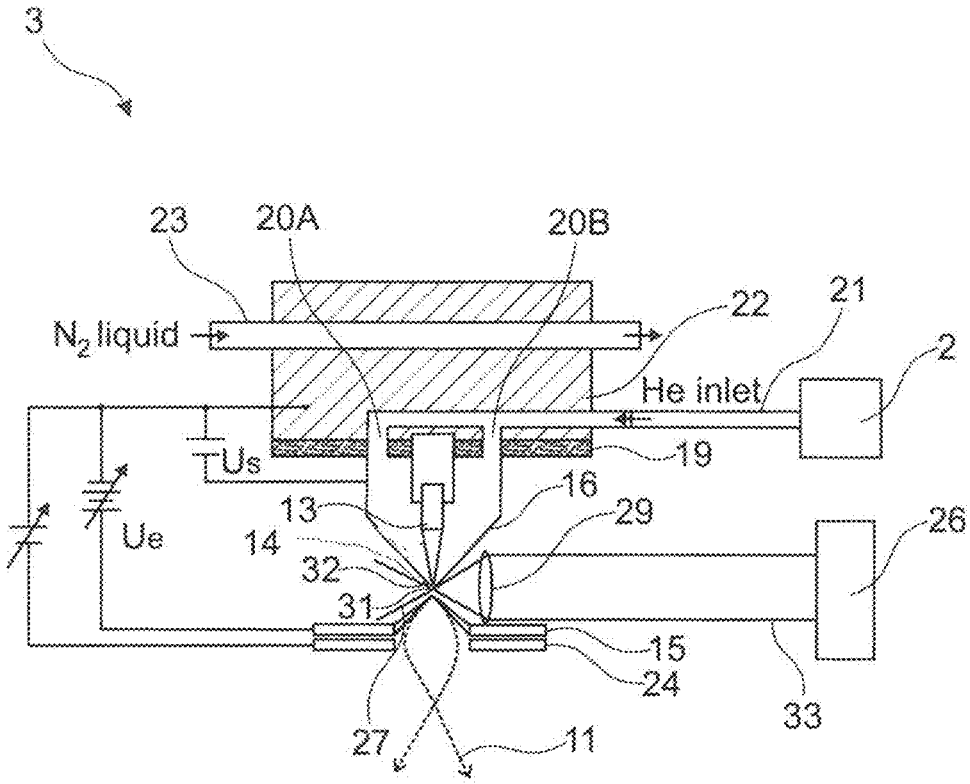
FIG. 3A shows a second embodiment of a charged particle source.

FIG. 3A shows a schematic side view of a further embodiment of the charged particle source 3. The embodiment of FIG. 3A is based on the embodiment of FIG. 2. Identical reference signs refer to identical components. The charged particle source 3 is arranged in a vacuum chamber (not shown). Furthermore, the embodiment of FIG. 3A comprises at least one optical fiber 33 which is connected between the light emitting device 26 and the lens 29. The optical fiber 33 transports the light beam 27 provided by the light emitting device 26 to the lens 29. The lens 29 focuses the light beam 27 to the focus point 31 in the ionization area 32.

Figure 3B:
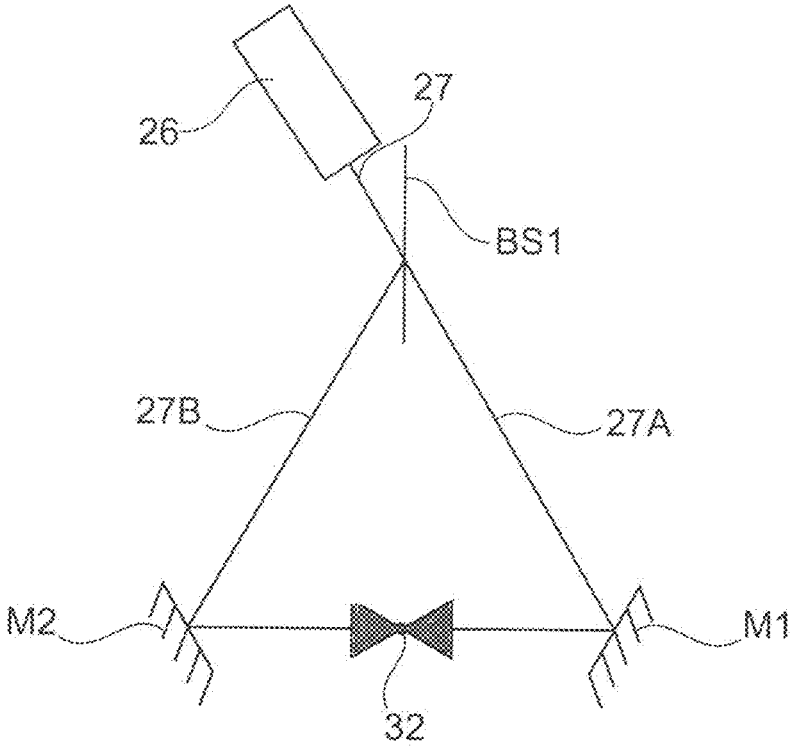
FIG. 3B shows a third embodiment of a charged particle source.

FIG. 3B shows a schematic top view of a further embodiment of a charged particle source 3. The embodiment of FIG. 3B is based on the embodiment of FIG. 2. However, the drawing only shows the relative arrangement of the light emitting device 26 and the ionization area 32. The light beam 27 of the light emitting device 26 is split into a first light beam 27A and a second light beam 27B by a beamsplitter BS1. The beamsplitter BS1 (and any further beamsplitter mentioned below) may be any kind of beamsplitter which splits a light beam into at least two further light beams. Such a beamsplitter may be, for example, an optical fiber or an optocoupling device. The first light beam 27A is guided to the ionization area 32 by a mirror M1. Moreover, the second light beam 27B is guided to the ionization area 32 by a mirror M2. This embodiment ensures that neutral gas particles being in a relatively large volume are trapped and directed to the ionization area 32, resulting in a higher concentration of neutral gas particles in the vicinity of the tip apex 14.

Figure 3C:
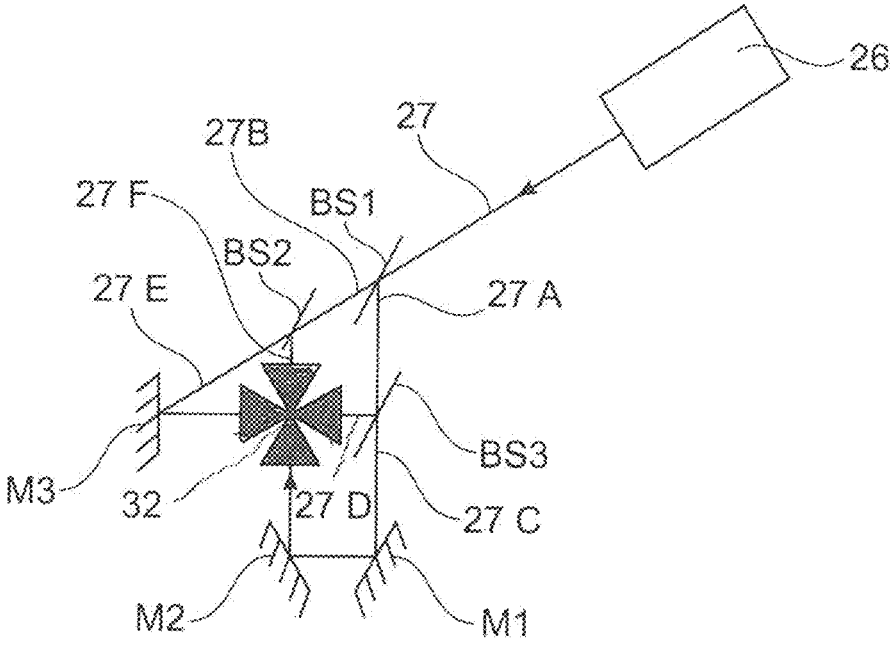
FIG. 3C shows a fourth embodiment of a charged particle source.

FIG. 3C shows a schematic top view of a further embodiment of a charged particle source 3. The embodiment of FIG. 3C is based on the embodiment of FIG. 2. However, the drawing only shows the relative arrangement of the light emitting device 26 and the ionization area 32. The light beam 27 of the light emitting device 26 is split into a first light beam 27A and a second light beam 27B by a beamsplitter BS1. The first light beam 27A is again split into a third light beam 27C and a fourth light beam 27D by a beamsplitter BS3. The fourth light beam 27D is directed to the ionization area 32. Moreover, the third light beam 27C is directed to the ionization area 32 by mirrors M1 and M2. The second light beam 27B is also split into two light beams, namely a fifth light beam 27E and a sixth light beam 27F, by a beamsplitter BS2. The sixth light beam 27F is directed to the ionization area 32. Moreover, the fifth light beam 27E is directed to the ionization area 32 by a mirror M3. This embodiment also ensures that neutral gas particles being in a relative large volume are trapped and directed to the ionization area 32, resulting in a higher concentration of neutral gas particles in the vicinity of the tip apex 14.

Figure 4:
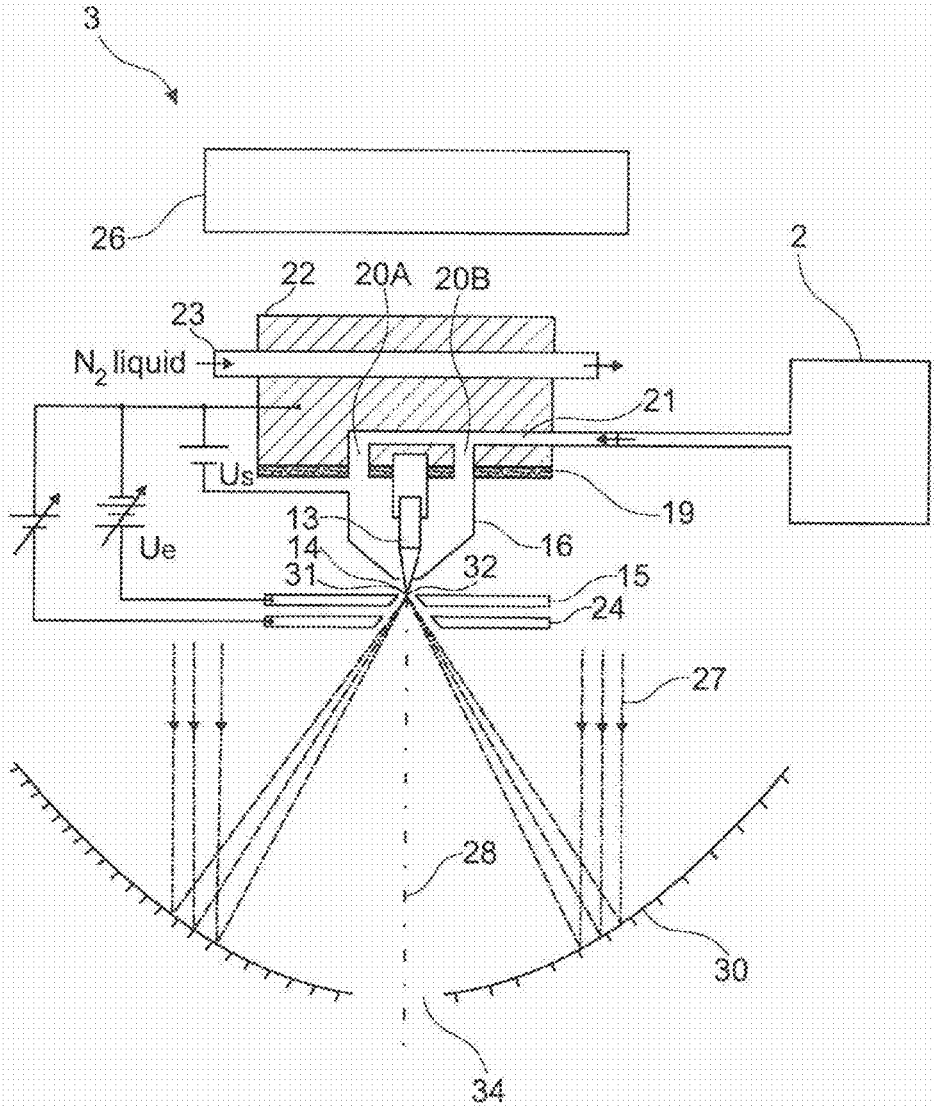
FIG. 4 shows a fifth embodiment of a charged particle source.

FIG. 4 shows a further embodiment of the charged particle source 3 which is based on the embodiment of FIG. 2. Identical reference signs refer to identical components. The charged particle source 3 is arranged in a vacuum chamber (not shown). Furthermore, the embodiment of FIG. 4 comprises a reflecting element 30 which is arranged behind the first electrode 15, seen from the tip 13 in the direction of the first electrode 15. The reflecting element 30 is configured as a parabolic mirror. The light emitting device 26 is arranged in front of the cooling unit 22, seen from cooling unit 22 in the direction of the first electrode 15. The light beam 27 is orientated parallel to the optical axis 28 when guided from the light emitting device 26 to the reflecting element 30. The reflecting element 30 focuses the light beam 27 to the focus point 31. The reflecting element 30 comprises an aperture 34 through which the ion beam 11 can pass.

Figure 5:
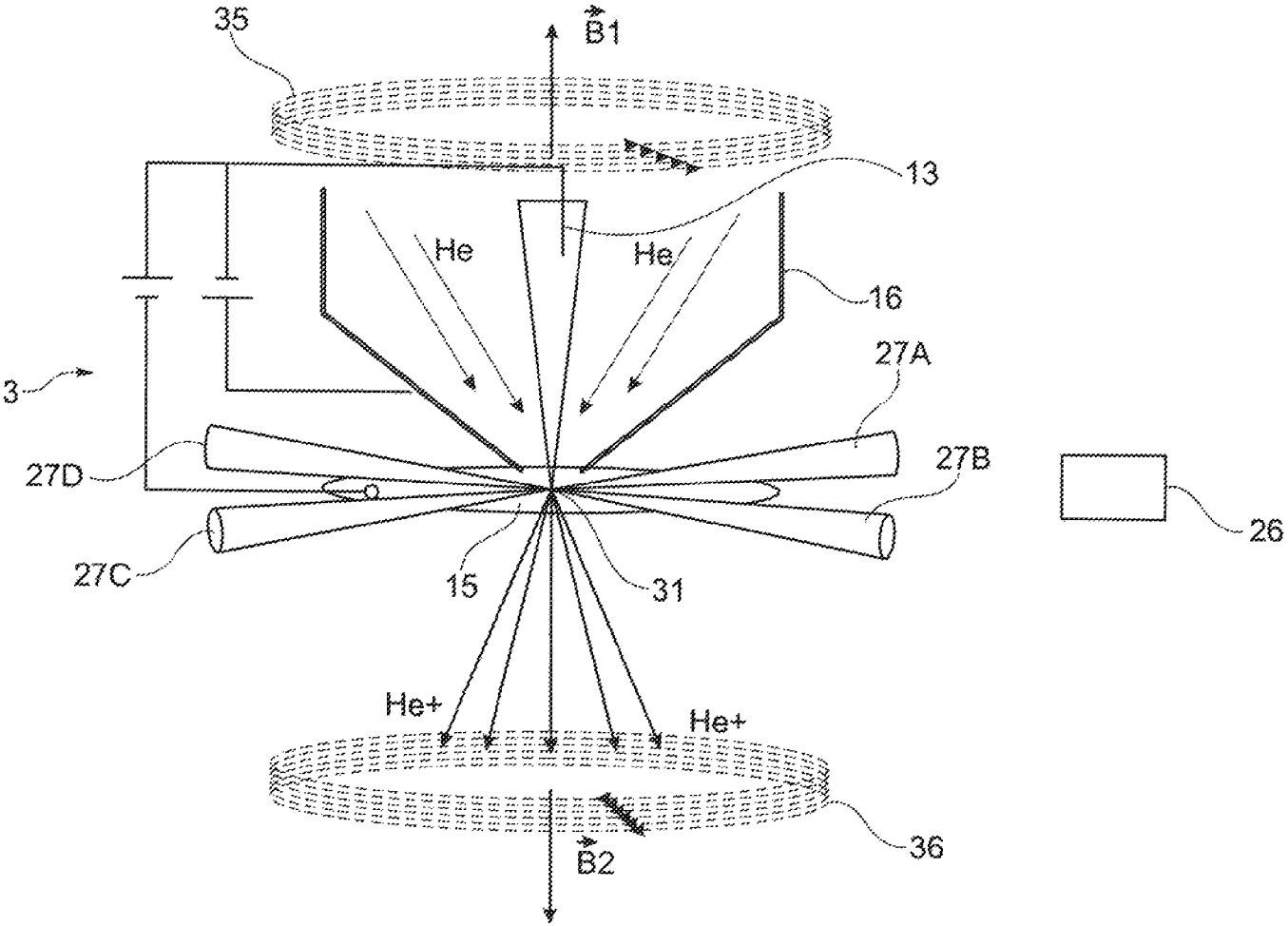
FIG. 5 shows a sixth embodiment of a charged particle source.

FIG. 5 shows a further embodiment of the charged particle source 3 which also comprises a magnetic field and a light emitting device 26. The embodiment of FIG. 5 is based on the embodiment of FIG. 3. Identical reference signs refer to identical components. The embodiment of FIG. 5 comprises a first coil 35 and a second coil 36 which are arranged at a distance from each other symmetrically around the focus point 31 at which the light of the light emitting device 27 is focused. The distance between the first coil 35 and the second coil 36 may equal to the radius of the first coil 35 and/or the second coil 36. In this embodiment, the first coil 35 generates a first magnetic field B1, whereas the second coil 36 generates a second magnetic field B2. The first magnetic field B1 and the second magnetic field B2 are orientated in opposite directions (so called anti Helmholtz configuration). The first magnetic field B1 and the second magnetic field B2 are orientated along an axis and are orientated towards the focus point 31 or are orientated away from the focus point 31.

Because of the opposing field directions of the magnetic fields B1 and B2, the magnetic field strength becomes zero in the focus point 31 and especially in the ionization area 32, and the absolute value of the magnetic field strength increases with increasing distance from the focus point 31 and the ionization area 32, but with opposing field directions.

Figure 6:
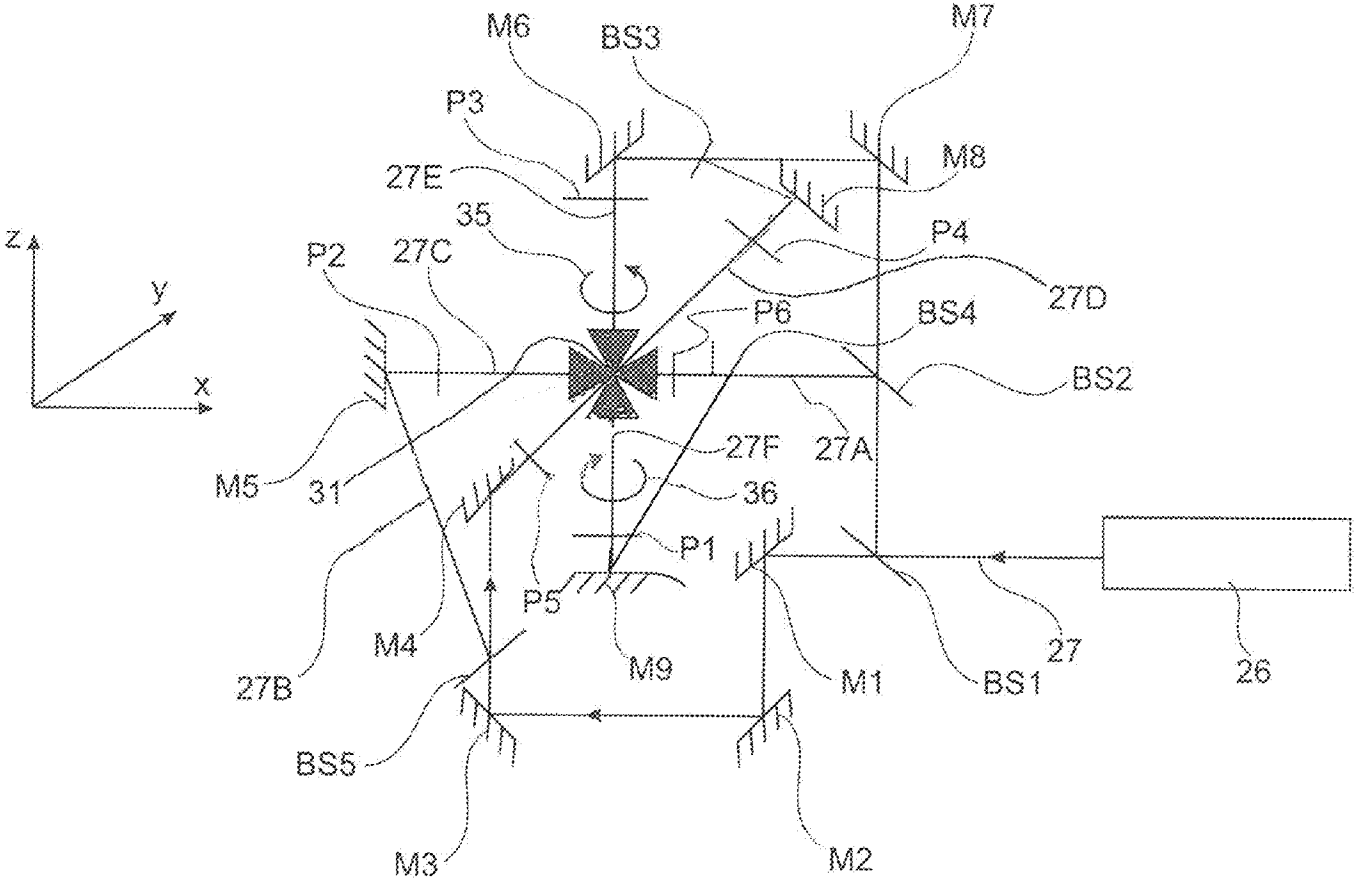
FIG. 6 shows an embodiment of a charged particle source having a single light emitting device.

The embodiment of FIG. 5 also comprises four light beams in form of laser beams, namely a first light beam 27A, a second light beam 27B, a third light beam 27C and a fourth light beam 27D. The first light beam 27A to fourth light beam 27D are arranged in a 90° arrangement. The first light beam 27A and the third light beam 27C are opposite to each other and are circularly polarized, wherein the polarization of the first light beam 27A is opposite to the polarization of the third light beam 27C. The second light beam 27B and the fourth light beam 27D are opposite to each other and are circularly polarized, wherein the polarization of the second light beam 27B is opposite to the polarization of the fourth light beam 27D. Moreover, the first light beam 27A to fourth light beam 27D are generated by the single light emitting device 26. Beam splitters and/or mirrors may be used to generate the first light beam 27A to fourth light beam 27D. FIG. 6 shows a schematic drawing of a top view of an embodiment using the single light emitting device 26 as a source for generating multiple light beams. The embodiment of FIG. 6 is based on the embodiment of FIG. 5. Therefore, identical reference signs refer to identical components. In contrast to FIG. 5, six light beams are directed to the focus point 31. BS1 to BS5 denote beamsplitters which split the light beam 27 into the above mentioned six different light beams, namely the first light beam 27A, the second light beam 27B, the third light beam 27C, the fourth light beam 27D, the fifth light beam 27E and the sixth light beam 27F. Several mirror elements M1 to M9 guide the light beams such that they are directed to the focus point 31. P1 to P6 denote wave plates (quarter wave plates) which adapt the polarization of the above mentioned light beams traveling through the specific wave plates which prevent interferences due to multiple reflections in the mirrors M1 to M9. Alternatively to the embodiment shown in FIG. 6, each of the above mentioned six light beams may be generated by a different light emitting device. In a further alternative embodiment, at least two of the above mentioned light beams are generated by a light emitting device which is different from another light emitting device or other light emitting devices providing the further light beams. The first light beam 27A, the second light beam 27B, the third light beam 27C, the fourth light beam 27D, the fifth light beam 27E and the sixth light beam 27F serve to cool (to slow down) the neutral gas particles in the ionization area which is located about 0.1 nm to 1 nm from the tip apex 14. The first magnetic field B1 and the second magnetic field B2 are used to trap the neutral gas particles in the ionization area 32. The neutral gas particles trapped in the ionization area 32 are ionized by the electric field provided in the vicinity of the ionization area 32.

Figure 7:
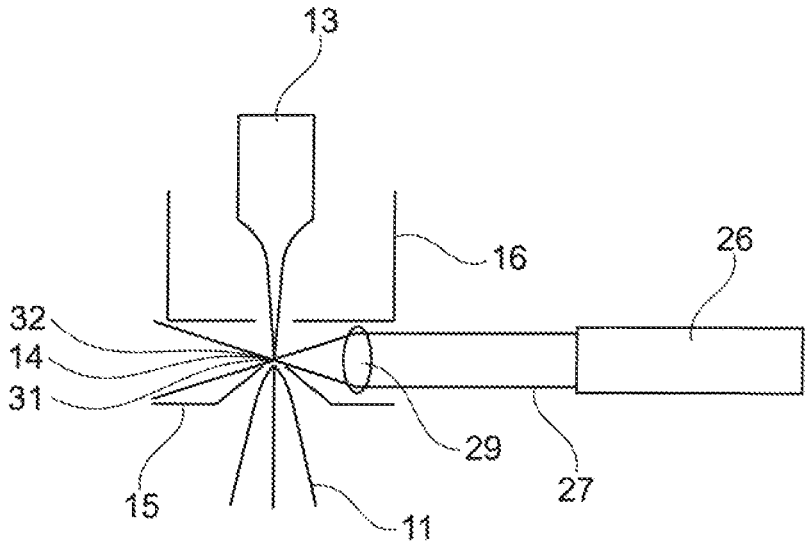
FIG. 7 shows a seventh embodiment of a charged particle source.

FIG. 7 shows a schematic side view of a further embodiment of the charged particle source 3. The embodiment of FIG. 7 is based on the embodiment of FIG. 3A. Identical reference signs refer to identical components. In this embodiment, the second electrode 16 is arranged above the first electrode 15 and above the tip apex 14. The tip 13 with its tip apex 14 extends through an opening of the second electrode 16.

Figure 8:
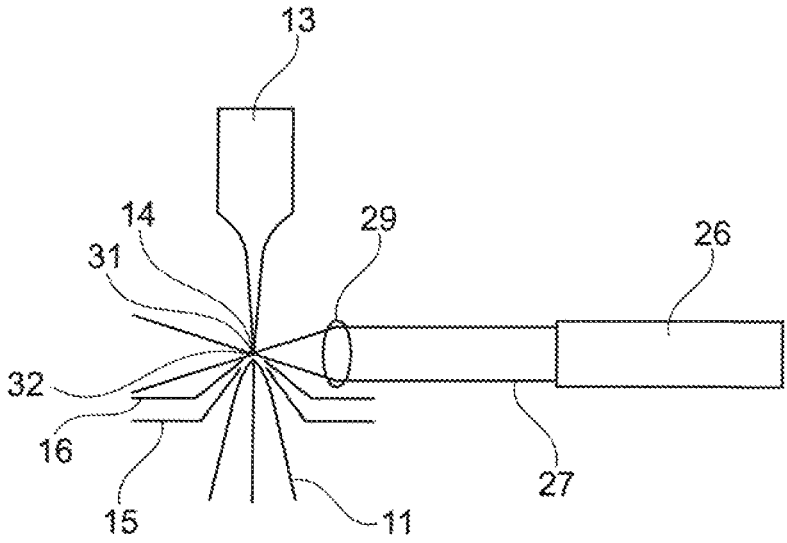
FIG. 8 shows an eighth embodiment of a charged particle source.

FIG. 8 shows a schematic side view of a further embodiment of the charged particle source 3. The embodiment of FIG. 8 is based on the embodiment of FIG. 3A. Identical reference signs refer to identical components. In this embodiment, the second electrode 16 is also arranged above the first electrode 15. However, the second electrode 16 is arranged between the tip apex 14 and the first electrode 15.

Figure 9:
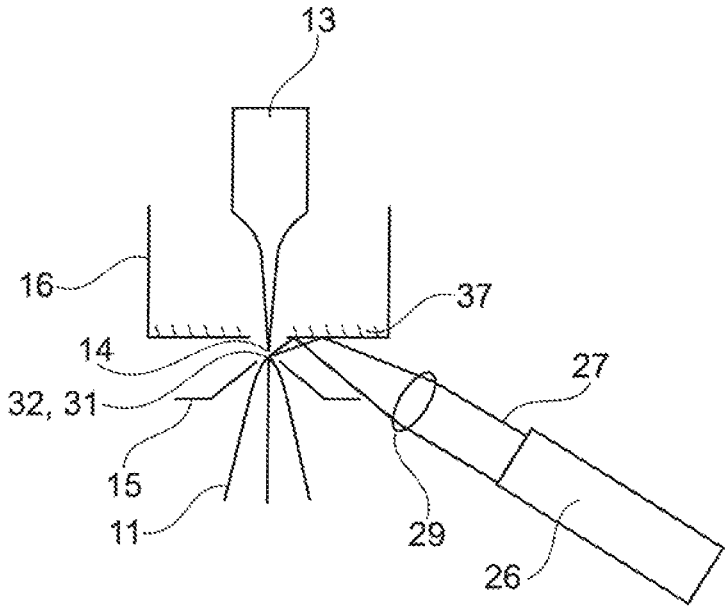
FIG. 9 shows a ninth embodiment of a charged particle source.

FIG. 9 shows a schematic side view of a further embodiment of the charged particle source 3. The embodiment of FIG. 9 is based on the embodiment of FIG. 2. Identical reference signs refer to identical components. In this embodiment, the second electrode 16 is arranged above the first electrode 15 and above the tip apex 14. The tip 13 with its tip apex 14 extends through an opening of the second electrode 16. Moreover, the second electrode 16 comprises a reflecting coating 37. The light emitting device 26 is arranged at an angle of approximately 45° with the horizontal in such a way that it provides the light beam 27 to the reflecting coating 37. The light beam 27 is reflected by the reflecting coating 37 and is directed to the focus point 31 in the ionization area 32.

Figure 10:
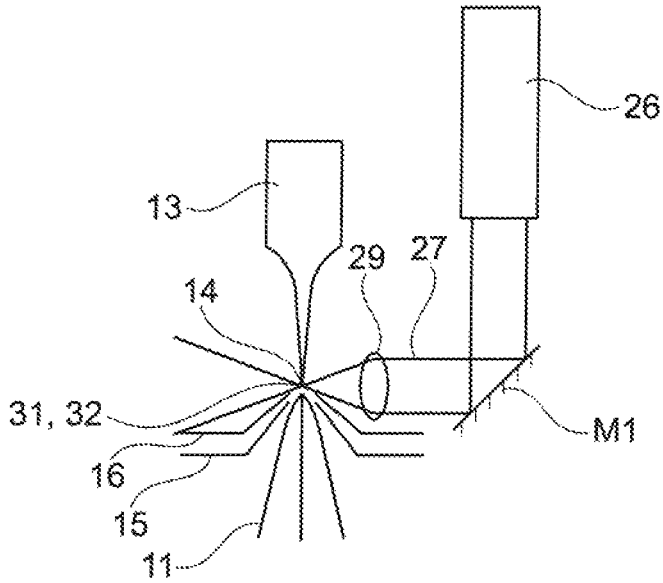
FIG. 10 shows a tenth embodiment of a charged particle source.

FIG. 10 shows a schematic side view of a further embodiment of the charged particle source 3. The embodiment of FIG. 10 is based on the embodiment of FIG. 8. Identical reference signs refer to identical components. However, the light emitting device 26 is arranged above the tip 13 and provides the light beam 27 parallel to the optical axis. A mirror M1 is used to change the direction of the light beam 27 and to provide it to the focus point 31 in the ionization area 32 with the lens 29.

Figure 11:
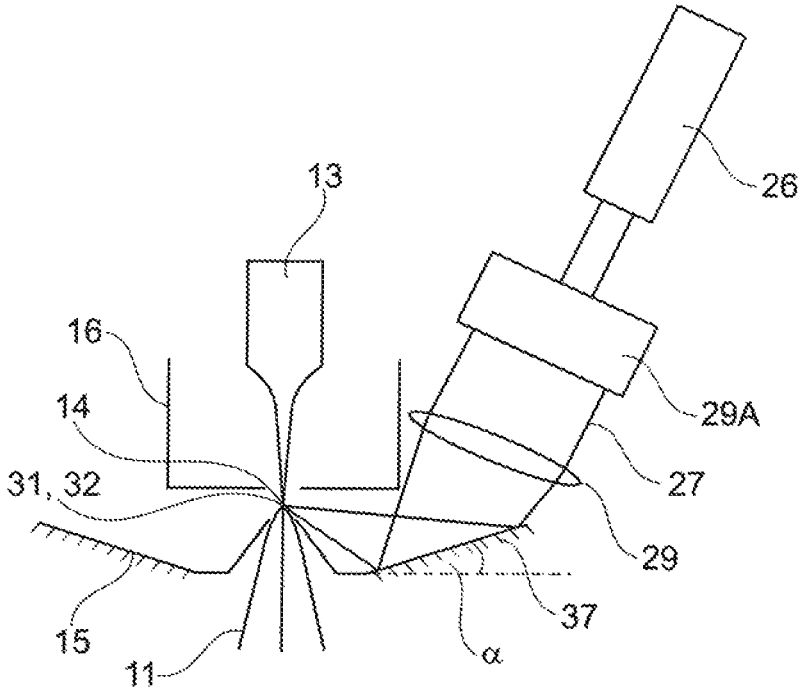
FIG. 11 shows an eleventh embodiment of a charged particle source.

FIG. 11 shows a schematic side view of a further embodiment of the charged particle source 3. The embodiment of FIG. 11 is based on the embodiment of FIG. 2. Identical reference signs refer to identical components. In this embodiment, the first electrode 15 is arranged at an angle of about 0° to 60° with respect to the horizontal. Moreover, it comprises a reflecting coating 37 on a surface directed to the second electrode 16. Additionally, the light emitting device 26 is arranged above the tip 13 (seen from the first electrode 15 in direction of the tip 13). The light beam 27 of the light emitting device 26 is formed by a forming unit 29A (for example a beam expander) and the lens 29, and is then reflected by the first electrode 15 and directed to the ionization area 32.

It should be noted that the ionization area 32 of all embodiments are formed at a distance of 0.1 nm to 1 nm in front of the tip apex 14 in the direction if the first electrode 15.

Various embodiments discussed herein may be combined with each other in appropriate combinations in connection with the system described herein. Additionally, in some instances, the order of steps in the flowcharts, flow diagrams and/or described flow processing may be modified, where appropriate. Further, various aspects of the system described herein may be implemented using software, hardware, a combination of software and hardware and/or other computer-implemented modules or devices having the described features and performing the described functions.

Software implementations of the system described herein may include executable code that is stored in a computer readable medium and executed by one or more processors. The computer readable medium may include volatile memory and/or non-volatile memory, and may include, for example, a computer hard drive, ROM, RAM, flash memory, portable computer storage media such as a CD-ROM, a DVD-ROM, a flash drive and/or other drive with, for example, a universal serial bus (USB) interface, and/or any other appropriate tangible or non-transitory computer readable medium or computer memory on which executable code may be stored and executed by a processor. The system described herein may be used in connection with any appropriate operating system.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed:

1. A charged particle source, comprising:

at least one gas inlet configured to supply gas particles;

at least one tip having a tip apex being biased to provide an electrical field for generating charged particles;

at least one ionization area, to which gas particles are supplied and in which gas particles are ionized;

at least one first electrode configured to accelerate charged particles, wherein said at least one ionization area is arranged between said tip apex and said at least one first electrode; and at least one light emitting device providing a light beam, said light beam being focused to a focus volume in a manner that the ionization area at least partly is positioned in the focus volume.

2. The charged particle source according to claim 1, further comprising:

at least one reflecting element for reflecting said light beam in the direction of said focus point.

3. The charged particle source according to claim 2, wherein said at least one reflecting element is a mirror element.

4. The charged particle source according to claim 2, further comprising one of the following:

(i) seen from said at least one ionization area in the direction of said at least one first electrode, said charged particle source comprises said at least one ionization area, said at least one first electrode and said at least one reflecting element;

(ii) seen from said at least one ionization area in the direction of said at least one first electrode, said charged particle source comprises said at least one reflection element, said at least one ionization area and said at least one first electrode; or (iii) seen from said at least one ionization area in the direction of said first electrode, said charged particle source comprises said at least one ionization area, said at least one reflection element and said at least one first electrode.

5. The charged particle source according to claim 1, further comprising at least one of:

(i) at least one optical fiber for guiding said light beam in the direction of said focus point, or (ii) at least one lens element for focusing said light beam on said focus point.

6. The charged particle source according to claim 1, further comprising:

an optical axis along which charged particles are accelerated from said at least one ionization area to said at least one first electrode, and wherein said light beam and said optical axis are arranged at an angle which is different to 0° and 180°.

7. The charged particle source according to claim 1, further comprising:

an optical axis along which charged particles are accelerated from said at least one ionization area in the direction of said at least one first electrode, and wherein said light beam and said optical axis are oriented parallel to each other.

8. The charged particle source according to claim 1, further comprising:

at least one chamber, wherein said at least one chamber comprises at least a part of said at least one tip, and wherein said at least one chamber comprises at least one cooling system.

9. The charged particle source according to claim 8, wherein said at least one chamber comprises at least one wall, and wherein said at least one wall comprises at least one coating.

10. The charged particle source according to claim 1, further comprising:

at least one second electrode, and wherein seen from said at least one ionization area in the direction of said at least one first electrode, said charged particle source comprises said at least one ionization area, said at least one second electrode and said at least one first electrode.

11. The charged particle source according to claim 10, wherein said at least one second electrode is a suppressor electrode.

12. The charged particle source according to claim 1, wherein said at least one first electrode is an extractor electrode.

13. The charged particle source according to claim 1, wherein said gas inlet is connected to a gas supply unit comprising at least one of the following gases: He, Ne, Ar, Kr or Xe.

14. The charged particle source according to claim 1, further comprising:

at least one magnetic device for providing a magnetic field.

15. The charged particle source according to claim 1, wherein said light beam is focused to the focus volume for cooling or trapping gas particles supplied by the at least one gas inlet.

16. A particle beam device, comprising:

at least one charged particle source; and at least one objective for focusing a particle beam on an object, wherein the at least one charged particle source includes:

at least one gas inlet configured to supply gas particles;

at least one tip having a tip apex being biased to provide an electrical field for generating charged particles;

at least one ionization area, to which gas particles are supplied and in which gas particles are ionized;

at least one first electrode configured to accelerate charged particles, wherein said at least one ionization area is arranged between said tip apex and said at least one first electrode; and at least one light emitting device providing a light beam, said light beam being focused to a focus volume in a manner that the ionization area at least partly is positioned in the focus volume.

17. The particle beam device according to claim 16, wherein the at least one charged particle source further includes at least one reflecting element for reflecting said light beam in the direction of said focus point.

18. The particle beam device according to claim 16, wherein the at least one charged particle source further includes at least one of:

(i) at least one optical fiber for guiding said light beam in the direction of said focus point;

(ii) at least one lens element for focusing said light beam on said focus point;

(iii) at least one chamber, wherein said at least one chamber comprises at least a part of said at least one tip, and wherein said at least one chamber comprises at least one cooling system; or (iv) at least one magnetic device for providing a magnetic field.

19. The particle beam device according to claim 16, wherein the at least one charged particle source includes one of:

(i) an optical axis along which charged particles are accelerated from said at least one ionization area to said at least one first electrode, and wherein said light beam and said optical axis are arranged at an angle which is different to 0° and 180°; or (ii) an optical axis along which charged particles are accelerated from said at least one ionization area in the direction of said at least one first electrode, and wherein said light beam and said optical axis are oriented parallel to each other.

20. The particle beam device according to claim 16, wherein the at least one charged particle source further includes:

at least one second electrode, and wherein seen from said at least one ionization area in the direction of said at least one first electrode, said charged particle source comprises said at least one ionization area, said at least one second electrode and said at least one first electrode.

* * * * *